United States Patent [19]

Vork

[11] 4,263,003

[45] Apr. 21, 1981

[54] METHOD OF MIXING LIQUIDS IN CLOSED CONTAINERS

[75] Inventor: William D. Vork, Edina, Minn.

[73] Assignee: Graco, Inc., Minneapolis, Minn.

[21] Appl. No.: 37,225

[22] Filed: May 8, 1979

[51] Int. Cl.[3] ..... B01F 13/00; B01F 3/00

[52] U.S. Cl. ..... 366/348; 366/605

[58] Field of Search ..... 366/348, 202, 210, 211, 366/605, 3

[56] References Cited

U.S. PATENT DOCUMENTS

| | | | |
|---|---|---|---|
| 2,118,362 | 5/1938 | Schletz | 366/211 |
| 3,542,344 | 11/1970 | Oberhauser | 366/202 |
| 3,776,527 | 12/1973 | Cover | 366/212 |
| 3,860,219 | 1/1975 | Nickelson | 366/3 |

*Primary Examiner*—Edward J. McCarthy

[57] ABSTRACT

A method is disclosed for mixing liquids in closed containers wherein the container is partially filled with a liquid such as paint and is moved over a closed path in a vertical plane such that the vertical velocity component of fluid movement causes a force component in the fluid within the container to displace the air therein away from the top of the container.

10 Claims, 13 Drawing Figures

METHOD OF MIXING LIQUIDS IN CLOSED CONTAINERS

BACKGROUND OF THE INVENTION

This invention relates to a method of mixing fluids in closed containers; more particularly the method relates to the mixing of paint and other liquids or slurries in cans which are partially filled.

The prior art as it relates to the field of mixing paints and other liquids has provided innumerable devices aimed at accomplishing effective mixing over relatively short time periods. These devices are typically intended for commercial use, as for example in a retail paint store, wherein customers purchase paint having one or more color components added to a base material, and the resulting mixture is briefly and thoroughly agitated to provide a uniform color and viscosity blend. Prior art devices and methods have had as a primary objective the thorough and effective mixing over as brief a time period as is possible, in order that sales may be rapidly accomplished and customer delay minimized. In order to accomplish this objective the apparatus for mixing has typically included a device for clamping about a paint container and for violently agitating the container for a period of thirty seconds to five minutes.

The machines designed for accomplishing the desired mixing motion have taken varied form. For example, U.S. Pat. No. 2,022,527, issued Nov. 26, 1935, discloses an oscillatory motion wherein the paint container is vertically positioned and rapidly oscillated about a horizontal axis passing through the container. U.S. Pat. No. 2,092,190, issued Sept. 7, 1937, accomplishes essentially the same oscillatory motion with a can laid on its side in a horizontal plane. U.S. Pat. No. 2,109,233, issued Feb. 22, 1938, describes a mixing motion wherein the axis of the container moves along a straight line while at the same time the container ends circumscribe roughly elliptical paths in opposite directions. U.S. Pat. No. 2,797,902, issued July 2, 1957 discloses a mixing motion wherein the paint container is subjected to a combined lateral swinging movement and a simultaneous horizontal oscillatory movement in which the lateral swinging motion is accomplished on a pivotal axis located below the center of gravity of the container and its contents. U.S. Pat. No. 3,552,723, issued Jan. 5, 1971, discloses a mixing motion wherein a paint container is given an unequal rocking motion about a pivot point causing the paint to circulate in one direction within the can, the axis about which the rocking motion is imparted being generally horizontal. U.S. Pat. No. 3,880,408, issued Apr. 29, 1975, describes a device for mixing paints wherein a frame is rotatably attached to a pedestal to permit rotation about a first axis, and the frame supports a can holder which is rotatably movable about a second perpendicular axis, and the drive means to cause the can to rotate about the second axis at the same time as the frame is rotating about the first perpendicular axis. Finally, U.S. Pat. No. 3,542,344, issued Nov. 24, 1970, discloses a paint mixer wherein a vertically positioned can is first rapidly rotated about a first vertical axis through the can, suddenly stopped and reverse-rotated about the same axis, and the action is repeated, the intention being to provide an internal vortex in the paint liquid which vortex is developed, destroyed, and redeveloped in the opposite direction.

All of the foregoing patents describe empirically derived machines and methods for imparting violent agitation to liquid within a container in one way or another with the hoped-for end result of obtaining a good fluid mix. A good fluid mix is frequently especially difficult to obtain with paint, because the components tend to settle out and accumulate on the bottom of the can during the shelf life of the paint container. These components must be brought back into suspension in the liquid in order to provide a paint which has the proper color and consistency for coating applications. It has heretofore been thought that the mixing operation could be best accomplished by violent agitation of the container in most any direction or directions for some limited period of time.

It has been difficult to obtain theoretical data relating to the conditions of fluid agitation which occur within the paint container, for the motion therein is a complex turbulent motion which is theoretically difficult, if not impossible to describe. Most of the theoretical studies of fluid turbulence have dealt with fluid behavior in a moving closed container. For example, in a book entitled *Boundary-Layer, Theory,* by Dr. Hermann Schlichting, published by the McGraw-Hill BooK Company, 1968, the observation is made that velocity and pressure at a fixed point in space under turbulent motion conditions do not remain constant with time but perform very irregular fluctuations of high frequency. "Lumps" of fluid perform such fluctuations, and these "lumps" do not consist of single molecules as assumed in the kinetic theory of gases; they are macroscopic fluid balls of varying small size. Scientific observation has confirmed that such velocity and pressure fluctuations also involve certain bigger portions of fluid volume which have their own intrinsic motion superimposed on the main fluid motion. Such "fluid balls" or "lumps" assume variable sizes which continually agglomerate and disintegrate, and reform and this action has been used to attempt to determine the scale of turbulence within any given set of conditions. It is believed that this type of pressure-velocity fluctuation, when produced in a paint mixing apparatus, creates turbulent conditions within the paint container which most satisfactorily and rapidly provide an effective mix of the fluid within the container. Therefore, it is desirable to devise a method for mixing paint which induces the maximum apparent turbulence into the paint, and it is an object of the present invention to provide such a method.

It is a further object of the present invention to provide a method for mixing paint which can be implemented by an apparatus at low energy costs, for although the prior art has recognized that violent agitation can be readily obtained by the application of high energy forces to liquids, the present invention contemplates a method for effectively mixing wherein the steps to perform the method consume a minimum amount of energy.

It is yet another object of the present invention to disclose a method of mixing which may be implemented by simple mechanical motion and which, to the extent possible, takes advantage of the forces of nature to accomplish the desired end result, and in this regard the present invention recognizes and utilizes the force of gravity in the performance of the method.

SUMMARY OF THE INVENTION

The present invention comprises a method for mixing liquids in closed containers wherein the container is only partially filled with liquid, leaving an air space therein, and the container is then moved about a closed path in a vertical plane at a rate of speed sufficient to cause the liquid within the container to displace the air space in the container away from the top of the container and to generally disperse the air molecules within the body of the liquid.

BRIEF DESCRIPTION OF THE DRAWINGS

A description of the preferred method is contained herein, and with reference to the appended drawings, in which.

DESCRIPTION OF THE PREFERRED METHOD

Figure 1:
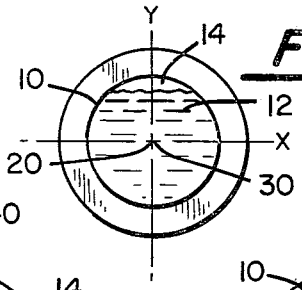
FIG. 1 illustrates schematically a partially filled container in cross section plan view.

Referring first to FIG. 1, there is illustrated in plan view a closed container 10 centered about the axes X and Y, such as paint or other liquid. In all of the figures there is shown an outer circle fixed relative to the X-Y axes, which circle is shown so as to better illustrate the relative positions of container 10. An air space 14 exists across the top of the container, which air space may be relatively greater or less than shown in the figures. The container of FIG. 1 is illustrative of a partially filled cylindrical container at rest wherein the container axis is illustrated by the point 20, which axis may be presumed to be perpendicular to the plane of the figure. Container 10 is preferably a cylindrical container of the type commonly used in the retail manufacture and sales of paint.

Figure 2A:
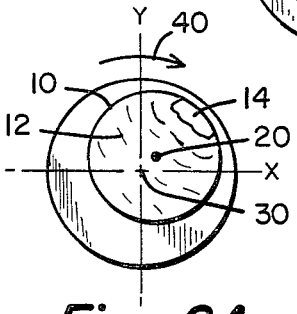
FIGS. 2A–2D illustrate in schematic plan view several positions of motion of the container of FIG. 1.
Figure 2B:
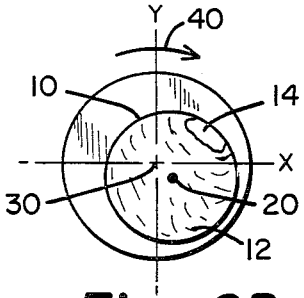
Figure 2C:
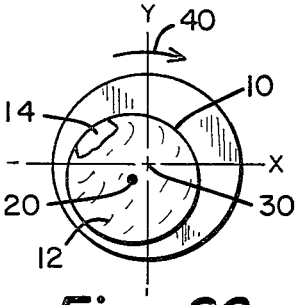
Figure 2D:
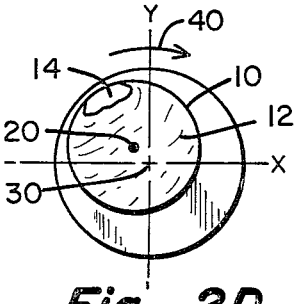

FIGS. 2A–2D show instantaneous motion positions of container 10 as it is rotated over a closed path, the axis of which is parallel to axis 20, but not necessarily coincident with axis 20. The closed path must have a substantial vertical excursion and, in the preferred embodiment it has been found that design simplicity dictates the closed path to have an equal horizontal excursion, for motion of this type is readily produced through the use of cams or crank mechanisms which are driven from a rotating shaft. FIG. 2A illustrates the axis 30 of the closed path to be the intersection of the X and Y centerlines, with point 20 being the axis of the container 10. Movement of the container about axis 30 is schematically indicated by the arrow 40, and under this moving influence air space 14 tends to migrate in the direction of motion and to become offset from the top center position of FIG. 1. FIG. 2B illustrates a second position of container 10 as motion continues about the closed path having an axis at 30. The relative position of air space 14 within container 10 reaches a maximum lateral displacement from the top position of FIG. 1, and does not further progress as angular movement 40 continues. FIG. 2C illustrates a third position of container 10 as movement continues about a closed path having its axis at 30. Air space 14 becomes displaced relatively leftward from its position in FIG. 2B, having rapidly moved from its position in FIG. 2B to the displaced position illustrated in FIG. 2C. FIG. 2D illustrates a further position for container 10 while moving about a closed path centered at axis 30, wherein air space 14 has shifted relatively closer toward the top of the container but is still relatively leftward displaced from its position in FIG. 1.

The illustrations of FIGS. 2A–2D show the relative displacment of the air space 14 within a container under conditions wherein container 10 moves over a closed path about an axis 30 at a relatively low angular rate. Under these conditions, it has been found that the air space 14 tends to remain near its quiescent position in the top of the container, but moves backward and forward about the quiescent position as illustrated, as the container completes its traverse of the closed path. In this situation fluid mixing within the container is relatively poor, the pigments and other solid materials not having imparted to them sufficient force to cause them to go into liquid suspension.

Figure 3A:
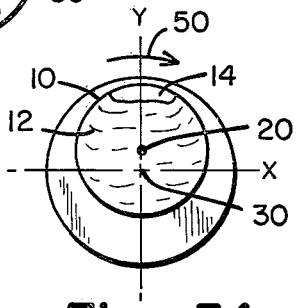
FIGS. 3A–3H illustrate several additional motion positions during acceleration of the closed container of FIG. 1.
Figure 3E:
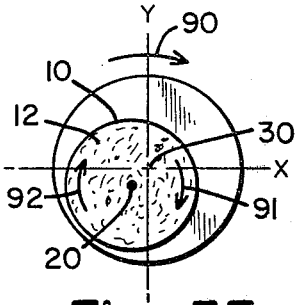
Figure 3B:
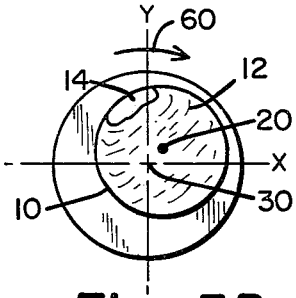
Figure 3F:
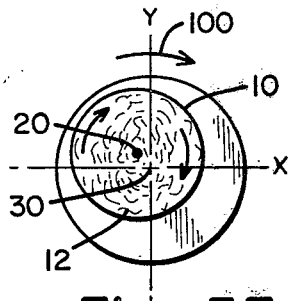
Figure 3C:
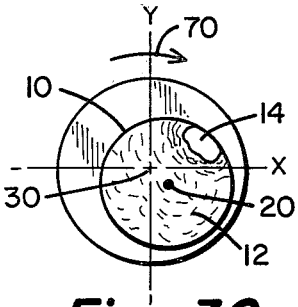
Figure 3G:
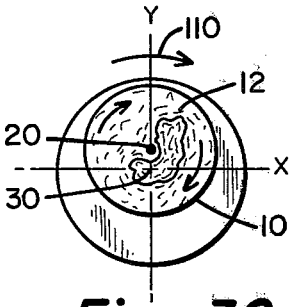
Figure 3D:
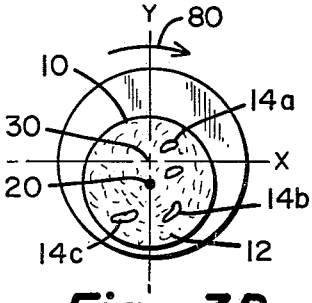
Figure 3H:
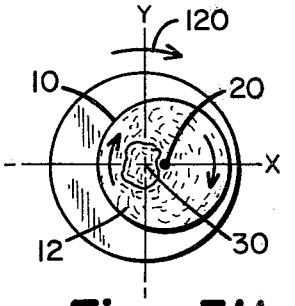

FIGS. 3A–3H illustrate instantaneous positions of container 10 under circumstances where the angular rate of motion about the closed path is accelerated. In FIG. 3A container 10 is in an instantaneous position similar to the positions shown in FIGS. 2A–2D, but it is to be presumed that the arrow 50 indicating angular motion signifies motion at a higher angular rate. FIG. 3B illustrates yet another position of container 10 wherein the rate of angular movement of container 10 about closed path axis 30, as indicated by arrow 60 is increased still further from that shown in FIG. 3A. FIG. 3C illustrates the effect which takes place as the rate of angular motion of container 10 about axis 30 increases beyond a critical value, as signified by arrow 70. At this rate of angular motion air space 14 begins breaking up and small air bubbles begin intruding into liquid 12. FIG. 3D illustrates an increased angular rate of movement 80, wherein the air space 14 has broken into a number of relatively large air bubbles **14*a*, 14*b*, 14*c*, etc. which tend to migrate into liquid 12. FIG. 3E illustrates an increased angular rate of movement 90, wherein the air bubbles increase in number and decrease relatively in size, and appear to begin an angular motion about axis 20, as indicated by arrows 91 and 92**.

FIG. 3F illustrates a phenomena which occurs at a particular angular rate of motion 100. At this particular angular rate, which appears to be a function of the material comprising liquid 12, the relative displacement of axis 20 from axis 30, and other factors, the air bubbles suddenly seem to diffuse more or less uniformly throughout the liquid 12. This appears to create a massive condition of turbulence within container 10, creating a very apparent and widespread internal disturbance. It is thought that at this rate of angular rotation of container 10 about axis 30 the maximum mixing efficiency occurs, and it has been observed that further increases in angular rate of travel of container 10, such as illustrated in FIG. 3G and FIG. 3F, do not increase the turbulence within the container. In fact, further increases of angular rate such as represented by 110 (FIG. 3G) and 120 (FIG. 3H) tend to develop an ever reducing turbulent zone, which zone tends to migrate toward axis 30, and remain relatively stationary about axis 30 at higher angular rates of motion.

The foregoing description shows that container 10 must be moved about a closed path, and that the closed path must have a vertical component of movement, and that the rate of travel about the closed path must be greater than a rate which permits air space 14 to remain relatively near the top of the container, but not so great as to concentrate the turbulence relatively about the axis of the closed path. Therefore, the preferred and proper method of mixing according to these teachings comprises the steps of filling a container partially with liquid, leaving an air space therein; moving the container about a closed path wherein the path has at least some vertical displacement; and moving the container about this path at a rate such that the air space within the container is displaced away from the top of the container and becomes intermixed with the liquid in the container to cause widespread turbulence throughout the container.

In operation, it has been found with a typical one gallon paint container that a closed path having a vertical displacement of from 3/16th–1⅛th inches is sufficient to cause the desired turbulence within the container, wherein the rate of motion about the closed path is limited to between 400–2100 RPM. The relative efficiency of mixing over these parameters is then determined by the characteristics of the liquid itself, but most ordinary and commercial paint mixtures have been found to be adequately mixed when operated over these ranges of displacement and angular rotation for a relatively short time in the range of 15–90 seconds.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A method of mixing liquid compositions in closed containers, comprising the steps of:

a. partially filling a container with a liquid composition, leaving an air volume therein;

b. moving the container about a closed path in a vertical plane at a cyclical rate; and c. setting the cyclical rate so as to disperse the liquid composition into the air volume in said container.

2. The method of claim 1, further comprising the step of continuing the movement of said container about said closed path for a time period of from 15 to 90 seconds.

3. The method of claim 1, wherein said closed path includes a vertical displacement of from 3/16-inch to 1⅛ inches.

4. The method of claim 1 wherein said cyclical rate is set between 400 revolutions per minute and 2100 revolutions per minute.

5. The method of claims 3 or 4, further comprising the step of continuing the movement of said container about said closed path for a time period of from 15 to 90 seconds.

6. A method of mixing liquid compositions in a closed cylindrical container, comprising the steps of:

a. partially filling said container with a liquid composition and filling the remainder of said container with an air volume;

b. positioning the cylindrical axis of said container horizontally;

c. moving said container about a closed path having an axis parallel with said cylindrical axis, said closed path being in a vertical plane; and d. selecting the rate of movement of said container about said closed path so as to turbulently intermix said liquid composition and said air volume.

7. The method of claim 6, further comprising the step of continuing the movement of said container about said closed path for a time period of from 15 to 90 seconds.

8. The method of claim 6, wherein said closed path includes a vertical displacement of from 3/16-inch to 1⅛ inches.

9. The method of claim 6, wherein said cyclical rate is set between 400 revolutions per minute and 2100 revolutions per minute.

10. The method of claims 8 or 9, further comprising the step of continuing the movement of said container about said closed path for a time period of from 15 to 90 seconds.

* * * * *